US007455126B2

(12) United States Patent
Cruz

(10) Patent No.: US 7,455,126 B2
(45) Date of Patent: Nov. 25, 2008

(54) PERCUSSIVE DRILL BIT, DRILLING SYSTEM COMPRISING SUCH A DRILL BIT AND METHOD OF DRILLING A BORE HOLE

(75) Inventor: Antonio Maria Guimaraes Leite Cruz, Rijswijk (NL)

(73) Assignee: Shell Oil Company, Houston, TX (US)

( * ) Notice: Subject to any disclaimer, the term of this patent is extended or adjusted under 35 U.S.C. 154(b) by 122 days.

(21) Appl. No.: 10/557,523

(22) PCT Filed: May 25, 2004

(86) PCT No.: PCT/EP2004/050912

§ 371 (c)(1),
(2), (4) Date: Nov. 18, 2005

(87) PCT Pub. No.: WO2004/104362

PCT Pub. Date: Dec. 2, 2004

(65) Prior Publication Data

US 2007/0039761 A1 Feb. 22, 2007

(30) Foreign Application Priority Data

May 26, 2003 (EP) ..... 03076614

(51) Int. Cl.
*E21B 10/36* (2006.01)
*E21B 10/38* (2006.01)

(52) U.S. Cl. ..... 175/57; 175/415; 175/418; 175/420.1

(58) Field of Classification Search ..... 175/414, 175/415, 417, 418, 420.1, 420.2, 57
See application file for complete search history.

(56) References Cited

U.S. PATENT DOCUMENTS 2,998,085 A 8/1961 Dulaney ..... 175/100

(Continued)

FOREIGN PATENT DOCUMENTS

DE 4200580 3/1993

(Continued)

OTHER PUBLICATIONS

International Search Report dated Aug. 30, 2004 (PCT/EP2004/050912).

(Continued)

*Primary Examiner*—Shane Bomar

(57) ABSTRACT

A percussion drill bit for drilling into a subterranean earth formation. The drill bit has a central longitudinal axis and is operable by applying axial percussive motion along the axis and rotary motion about the axis. The drill bit is provided with a plurality of blades protruding from the drill bit and, a plurality of flow channels stretching along the drill bit in a substantially radial direction whereby the successive flow channels are formed between two adjacent blades. Shear cutters are provided in a row on or close to the leading edge of at least one of the blades with respect to the direction of rotary motion trailingly adjacent to the flow channel that is associated with it. A fluid may be run through the flow channel to remove cutting debris accumulating in front of the row of shear cutters. In addition to these shear cutters, axial cutters are located, with respect to the direction of rotary motion, in a trailing position with respect to the row of shear cutters and its associated flow channel.

20 Claims, 4 Drawing Sheets

U.S. PATENT DOCUMENTS

| | | | | | |
|---|---|---|---|---|---|
| 3,140,748 | A | | 7/1964 | Engle et al. | 175/410 |
| 3,258,077 | A | | 6/1966 | Phipps | 175/389 |
| 3,269,470 | A | | 8/1966 | Kelly, Jr. | 175/410 |
| 3,388,756 | A | | 6/1968 | Varel et al. | 175/410 |
| 3,709,308 | A | | 1/1973 | Rowley et al. | 175/329 |
| 3,788,409 | A | | 1/1974 | Curington | 175/410 |
| 3,955,635 | A | | 5/1976 | Skidmore | 175/400 |
| 4,051,912 | A | * | 10/1977 | White | 175/426 |
| 4,296,825 | A | | 10/1981 | Larsson | 175/410 |
| 4,558,753 | A | | 12/1985 | Barr | 175/329 |
| 4,607,712 | A | | 8/1986 | Larsson | 175/410 |
| 4,676,324 | A | | 6/1987 | Barr et al. | 175/393 |
| 4,716,976 | A | | 1/1988 | Isakov | 175/410 |
| 4,823,892 | A | * | 4/1989 | Fuller | 175/428 |
| 4,991,670 | A | | 2/1991 | Fuller et al. | 175/329 |
| 5,004,056 | A | | 4/1991 | Goikhman et al. | 175/293 |
| 5,025,875 | A | | 6/1991 | Witt | 175/393 |
| 5,244,039 | A | * | 9/1993 | Newton, Jr. et al. | 175/431 |
| 5,460,233 | A | | 10/1995 | Meany et al. | 175/428 |
| 5,595,252 | A | | 1/1997 | O'Hanlon | 175/57 |
| 5,601,477 | A | | 2/1997 | Bunting et al. | 451/59 |
| 5,890,551 | A | | 4/1999 | Liljebrand et al. | 175/418 |
| 5,992,547 | A | * | 11/1999 | Caraway et al. | 175/385 |
| 6,202,770 | B1 | | 3/2001 | Jurewicz et al. | 175/428 |
| 6,253,864 | B1 | | 7/2001 | Hall | 175/415 |
| 6,290,002 | B1 | | 9/2001 | Comeau et al. | 175/73 |
| 6,527,065 | B1 | | 3/2003 | Tibbitts et al. | 175/339 |
| 6,672,406 | B2 | | 1/2004 | Beuershausen | 175/57 |
| 6,918,455 | B2 | | 7/2005 | Meyers et al. | 175/420.2 |
| 2002/0066601 | A1 | | 6/2002 | Meiners et al. | 175/431 |
| 2005/0269139 | A1 | | 12/2005 | Shen et al. | 175/430 |
| 2006/0131075 | A1 | * | 6/2006 | Cruz | 175/57 |
| 2006/0249309 | A1 | * | 11/2006 | Cruz | 175/57 |

FOREIGN PATENT DOCUMENTS

| | | | |
|---|---|---|---|
| EP | 0563561 | | 10/1993 |
| WO | 01/33031 | | 5/2001 |
| WO | 02/099242 | | 12/2002 |
| WO | WO03004249 | A1 | 1/2003 |
| WO | 03/031763 | | 4/2003 |
| WO | WO 03/031763 | A1 * | 4/2003 |
| WO | 03/042492 | | 5/2003 |
| WO | WO 2004/111381 | A1 * | 2/2004 |
| WO | WO 2004/104363 | A1 * | 12/2004 |
| WO | WO2004104362 | A1 | 12/2004 |

OTHER PUBLICATIONS

Intl. Preliminary Examination Report (PCT/EP2004/050912).

TH6436 PCT/PCT/EP2004/051094, International Search Report, dated Aug. 25, 2004.

International Search Report, PCT/EP2004/050913, dated Sep. 1, 2004.

IPER, TS6432 PCT, EP2004, 050913, dated May 17, 2005.

* cited by examiner

PERCUSSIVE DRILL BIT, DRILLING SYSTEM COMPRISING SUCH A DRILL BIT AND METHOD OF DRILLING A BORE HOLE

PRIORITY CLAIM

The present application claims priority of European Patent Application No. 03076614.1 filed 26 May 2003.

FIELD OF THE INVENTION

The present invention relates to a percussion drill bit for drilling into a subterranean earth formation, the drill bit having a central longitudinal axis and being operable by applying axial percussive motion along the axis and rotary motion about the axis.

The invention further relates to a drilling system for drilling a borehole in an earth formation, comprising a drill string provided with such a percussion drill bit, and to a method of drilling a bore hole into a subterranean earth formation.

The invention also relates to a method of drilling a bore hole into a subterranean earth formation.

BACKGROUND OF THE INVENTION

A percussive shearing drill bit is known and described in U.S. Pat. No. 6,253,864. FIG. 4 of said US patent depicts a percussive shearing bit having a unitary body, a means for attachment to a drill string, and a plurality of blades housing a plurality of shear cutting elements. Fluid outlets are situated on the head of the unitary body between the blades. The blades consist of a series of receptacles to house the shear cutting elements and a shelf that runs along each blade before the cutting elements. The shelf serves to direct cuttings away from the operative surface of the bit.

In operation, the known percussive shearing drill bit is rotated about its longitudinal axis shearing off the rock formation as the drill bit rotates. A hammer simultaneously impacts the bit thereby providing an additional percussive drilling force. The shear cutting elements have been specially designed to withstand the unusual stresses induced by combined percussive/shear drilling, in that a distal portion of the shear cutter has been rounded to prevent large localised stresses in the cutters.

It is thus a disadvantage of this known percussive shearing drill bit that its requires commodity shear cutting elements. In these commodity shear cutting elements a compromise is found for both shearing and axial cutting. Since the compromise is based on the rounded shape of the distal portion, the compromise is lost upon wear of the shear cutting elements which forms another disadvantage of this known percussive shearing drill bit.

SUMMARY OF THE INVENTION

According to the invention there is provided a percussion drill bit for drilling into a subterranean earth formation, the drill bit having a central longitudinal axis and being operable by applying axial percussive motion along the axis and rotary motion about the axis, the drill bit comprising:

- a plurality of blades protruding from the drill bit;
- a plurality of flow channels stretching along the drill bit in a substantially radial direction whereby the successive flow channels are formed between two adjacent blades;
- shear cutters which are provided in a row on or close to the leading edge of at least one of said blades with respect to the direction of rotary motion trailingly adjacent to the flow channel that is associated with it, for running a fluid through and thereby removing cutting debris accumulating in front of the row of shear cutters; and in addition to these shear cutters;
- axial cutters which are located, with respect to the direction of rotary motion, in a trailing position with respect to the row of shear cutters and its associated flow channel.

The drill bit according to the invention comprises axial cutters in addition to the shear cutters. The primary function of the axial cutters is to receive the percussive impacts between the drill bit and the earth formation, whereas the primary function of the shear cutters is to scrape off cutting debris from the bottom of the bore hole.

Since at least part of the axial impacts accompanying the percussive motion is taken by the axial cutting elements, the operational lifetime of the shear cutting elements is further sustained.

The effectiveness of the shear cutters is maintained at the same time, since the axial cutters are provided in a trailing position with respect to the row of shear cutters so that the substantially radial flow channel is fully effective in removing cutting debris accumulating in front of the row of shear cutters. Herewith, so called bit balling, whereby rock flour and rock chips ploughed in front of the shear cutters mix with drilling fluid such as water, oil or mud to form a paste in the bottom of the bore hole is avoided. Bit balling is undesired, since the resulting paste takes the weight of the bit instead of the underlying rock.

As an additional advantage of the invention, the axial cutters can be optimised for axial cutting action, whereas the shearing cutters can independently be optimised for shear cutting without having to take into account axial cutting capability.

The distal portion of the shear cutters can be sharp, and remain sharp for a relatively long operational time, in order to achieve a high shearing effectivity. In particular, the shear cutters can have a higher shearing effectivity than the axial cutters.

In particular, the axial cutters can be more resistant to axial impacts than the shear cutters.

It has also been found that the drill bit according to the invention allows for continued operation even with moderate wear on the cutting elements, without suffering from significant lower drilling rates.

It is remarked that in U.S. Pat. No. 6,253,864, in FIG. 9, a percussion drill bit is disclosed wherein the percussive and shearing components of drilling are accomplished by separate cutters whereby dome-shaped axial cutters are optimised for percussive penetration of the earth formation and shear cutters are optimised for shear penetration. However, the axial cutters in this known percussion drill bit are disposed ahead of the cutting elements. Consequently, this known percussion drilling bit does not have flow channels directly ahead of and adjacent to the shear cutters, but it has localised high pressure nozzles and jets directed to the cutters, instead. Without the flow channels ahead of the shear cutters, the cutting debris is insufficiently removed and the axial cutting elements, because of being disposed ahead of the shear cutters which is there where the cutting debris is pushed to by the shear cutters, even assist in occurrence of undesired bit balling.

In an advantageous embodiment, the axial cutters are located on the same blade as the shear cutters. Herewith a robust and stable percussion drill bit is achieved.

In a particularly advantageous embodiment, the axial cutters are directly followed by the next flow channel, preferably without being separated from the next flow channel by one or more shear cutters. This way, any bit balling that may start under the axial cutters of the first blade is cleaned away by the subsequent neighbouring flow channel that is associated with the row of shear cutters of the next blade.

The number of axial cutters in relation to the number of shear cutters can be optimal in dependence of the type of earth formation to be drilled. Earth formations containing relatively hard rock, such as granite, can be drilled with relatively fewer shear cutters and greater total number of cutters, thereby distributing the percussive impact over a larger number of axial cutters. A softer formation, such as a lime stone or a sand stone, is best drilled using a bit having relatively many shear cutters because impact forces are lower and the chance of bit balling is higher.

An embodiment wherein there are more axial cutters provided than shearing cutters is preferred for drilling harder earth formations.

The invention also provides a drilling system for drilling a borehole in an earth formation, comprising a drill string provided with a percussion drill bit as described above, the drilling system further comprising:

first drive means for rotating the drill bit in the borehole so as to induce a scraping movement of the shear cutters along the borehole bottom; and second drive means for inducing a longitudinal reciprocal movement of the drill bit in the borehole so as to induce at least the axial cutters to exert a percussive force to the borehole bottom.

In an advantageous embodiment, one or more of the shear cutters is provided with a pre-cut flat impact surface essentially parallel to the plane perpendicular to the longitudinal axis. Even though there are provided axial cutters for taking the axial percussive force, it cannot be avoided that the shear cutters take part of the impact. Due to the pre-cut flat impact surface, the impact stress concentration on the shear cutters is reduced and as a result they do not break as soon as shear cutters that do not have a pre-cut flat impact surface. A natural wear flat has been found not to be sufficiently flat to effectively reduce the impact stress concentration.

The drill bit or drilling system provided with shear cutters having the pre-cut flat impact surface has been found to cause fewer stick-slip torsional vibration modes in the drilling system, whereby the bit is hammered to a standstill into the earth formation while the drill string is twisted by the surface rotary drive until it abruptly releases with relatively high rotational speed. Such a stick-slip torsional vibration repeats periodically and the high rotational speed associated with the stick-slip torsional vibration can severely damage the cutters on the drill bit.

The method of the invention comprises the steps of providing a drilling system in accordance with one of the above defined embodiments, placing the drill bit against the subterranean earth formation that is to be drilled, exercising a rotary motion about the axis while maintaining a force on the drill bit against the earth formation in the axial direction, and intermittingly providing percussive strikes on the drill bit.

BRIEF DESCRIPTION OF THE DRAWINGS

The invention will now be illustrated by way of example, with reference to the accompanying drawing wherein.

DETAILED DESCRIPTION OF THE INVENTION

Figure 1A:
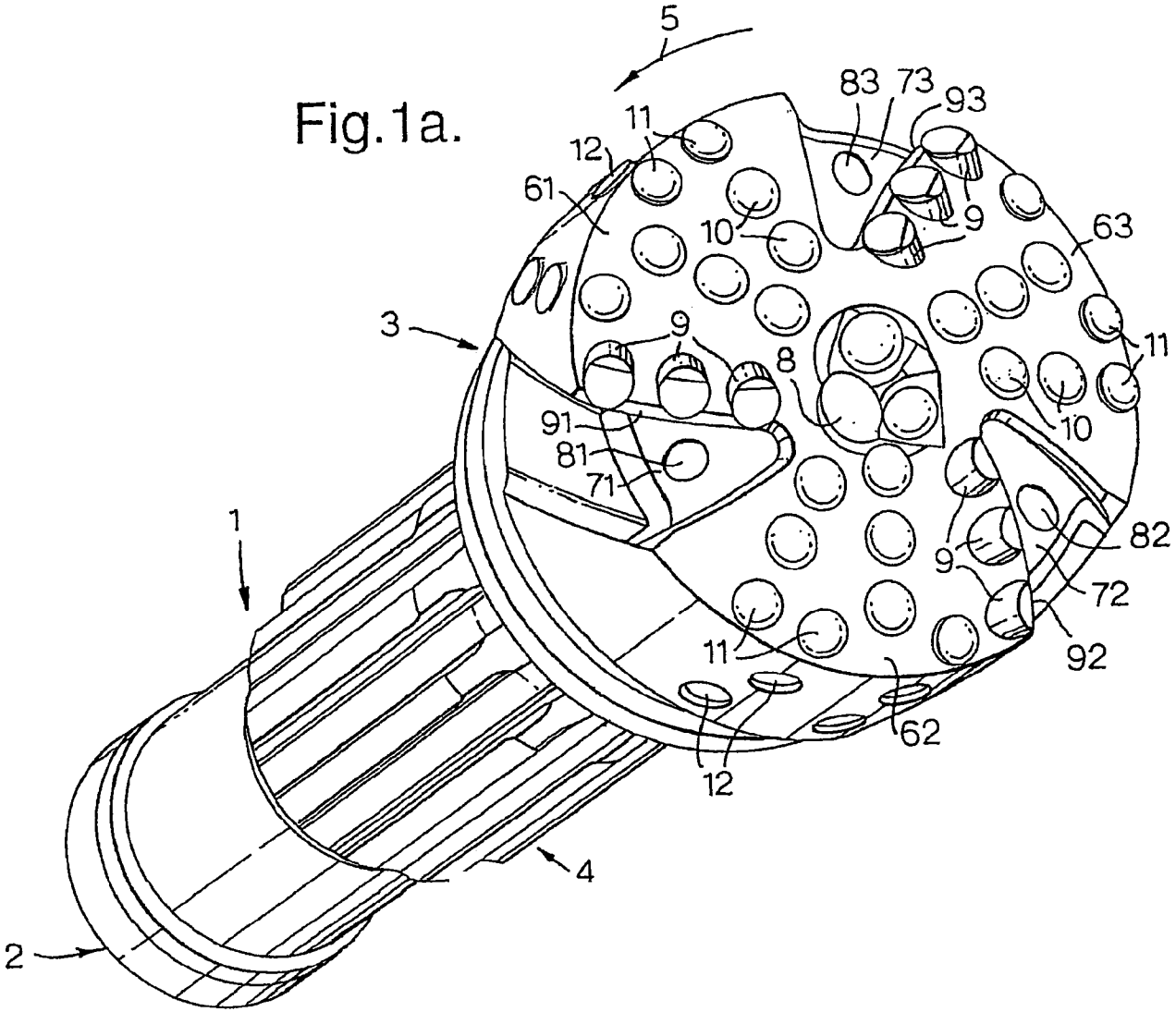
FIG. 1*a* shows a perspective view of a 6" 3-blade percussion drill bit in accordance with an embodiment of the invention.

In the figures, like parts carry identical reference numerals.

A perspective view of a 3-blade percussion drill bit in accordance with an embodiment of the invention is shown in FIG. 1*a*. The drill bit comprises a shank 1 stretching longitudinally about a central longitudinal axis of the drill bit, which shank can be especially adapted to fit inside a drill string. The rearward end of the shank is connected to a striking surface 2 to receive impacts from a percussive hammer, preferably a reciprocative piston hammer (not shown). The forward end of the shank is connected to a drilling head 3. The shank 1 is provided with a plurality of splines 4, running essentially longitudinally along the shank 1. The splines 4 serve to rotationally couple the drill string and the shank 1, so that the drill bit is operable by applying both axial percussive motion and rotary motion about the central longitudinal axis.

Figure 1B:
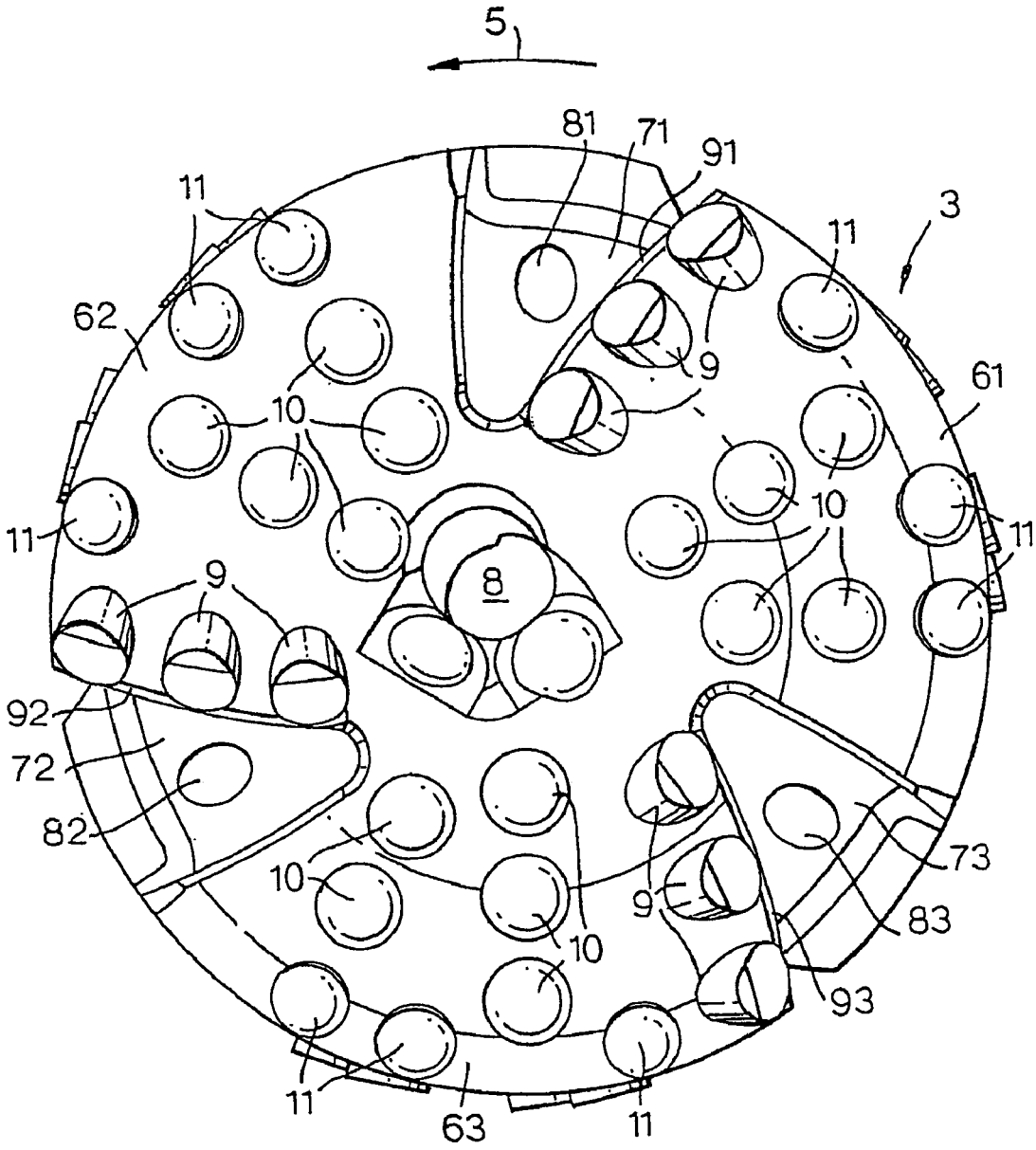
FIG. 1*b* shows a top view of the bit face of the percussion drill bit shown in FIG. 1*a;*

Referring now to FIGS. 1*a* and 1*b*, the drilling head 3 is provided with three blades 61, 62, and 63 that protrude from the drill bit. The areas between the blades 61, 62, 63 are recessed with respect to the blades and thus form flow channels 71, 72, 73. The flow channels 71, 72, 73, essentially run radially along the drilling head 3.

A central passage way 8 is provided in the drilling head 3 for passing of flushing fluid. In addition of or instead of the central passage way 8, passage ways 81, 82, 83, can be provided in the flow channels 71, 72, 73 between the blades 61, 62, 63. The passage ways are all connected to a central longitudinal bore (not shown) running through the shank 1.

In hydro-carbon well drilling operations, the drill string is conventionally rotated in clock-wise direction. Arrows 5 in FIGS. 1*a* and 1*b* depict the direction of rotary motion that, in operation, is applied to the drill bit.

The blades 61, 62, 63 thus each have a leading edge 91, 92, 93, with respect to the direction of rotary motion 5. Shear cutters 9 are provided in a row on the leading edge 91, 92, 93 of each respective blade 61, 62, 63. Each row of shear cutters 9 has a flow channel associated with it directly in front of the row of shear cutters 9 with respect to the direction of rotary motion 5. The shear cutters 9 have a shape optimised for scraping along the bottom of the bore hole and thereby shearing pieces of the earth formation from the bottom of the bore hole.

Behind each row of shear cutters 9, thus in a trailing position with respect each row of shear cutters 9, axial cutters 10, 11, are provided on the blades 61, 62, 63. The axial cutters 10, 11, have a shape optimised for axially indenting the earth formation in the bottom of the bore hole and thereby possibly crushing the earth formation.

The outer peripheral sections of the blades 61, 62, 63 can be provided with gauge protectors 12, preferably PDC coated.

Figure 2A:
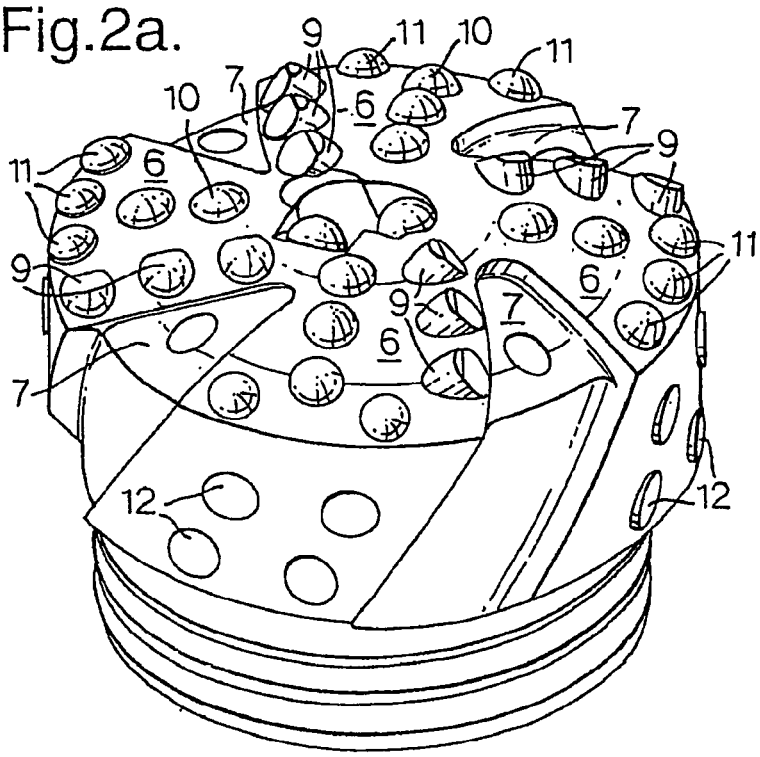
FIG. 2*a* shows a perspective view of a 6" 4-blade percussion drill bit in another embodiment of the invention.
Figure 2B:
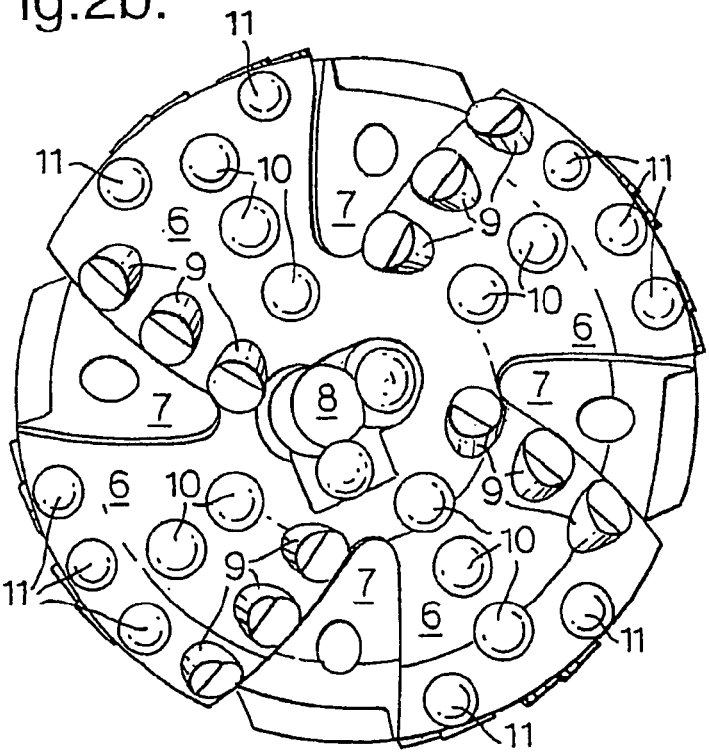
FIG. 2*b* shows a top view of the bit face of the percussion drill bit shown in FIG. 2*a;*

FIG. 2*a* shows a perspective view, and FIG. 2*b* a top view, of a variant of the drill bit of the invention having four blades 6 and consequently four flow channels 7. In other respects, this variant is similar to the one shown in FIGS. 1*a* and 1*b*. In particular, the positioning of the rows of shear cutters 9 on the leading edges of the blades and the positioning of the axial cutters 10, 11 in a trailing position with respect to the rows of shear cutters 9, are similar to the first discussed embodiment.

Figure 3:
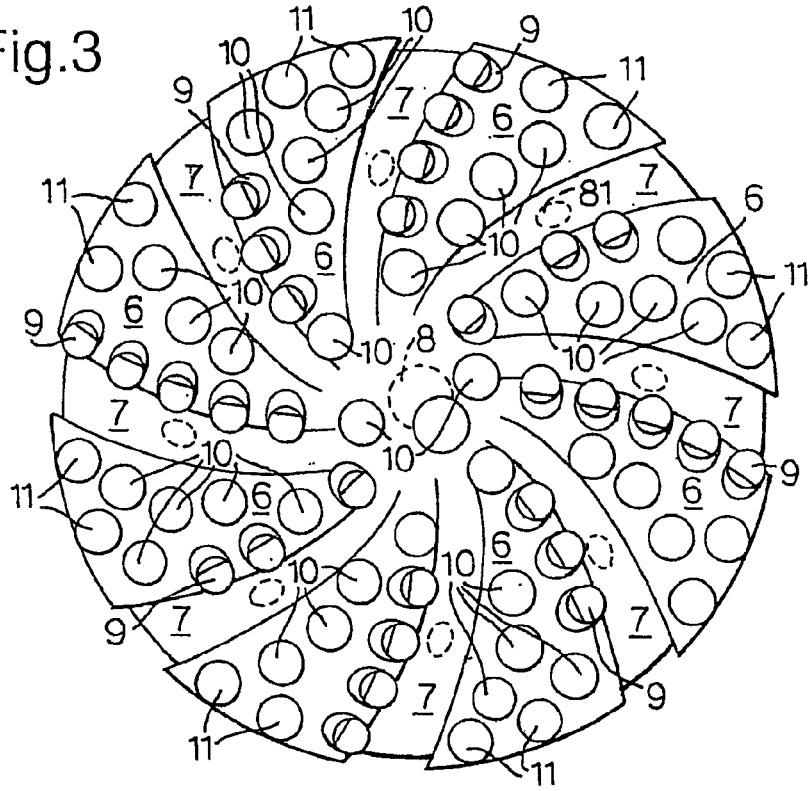
FIG. 3 shows a top view of an 8" bit face according to still another embodiment of the invention, having 8 blades.

The diameter of the outer periphery of the percussion drill bits discussed above in FIGS. 1*a* and 1*b*, and FIGS. 2*a* and 2*b*, is 6", corresponding to approximately 15 cm. An example of an 8" (corresponding to approximately 20 cm outer diameter) bit face is depicted in FIG. 3. This embodiment is based on eight blades 6 and a corresponding number of flow channels 7. Each flow channel 7 is provided with a passage way 81 for allowing entry of flushing fluid into the respective flow channel. Since this bit face of FIG. 3 has a larger diameter than the ones shown in FIGS. 1 and 2, a larger number of shear cutters 9 and axial cutters 10,11 can be accommodated.

In the above described percussion drill bits depicted in FIGS. 2*a* and 2*b* and FIG. 3, the shear cutters in a first said row of shear cutters are positioned at mutually different radial positions than the shear cutters in a second said row of shear cutters on another blade. This way, the gaps left between adjacent shear cutters in one row are covered by the shear cutters in a next row on a different blade when the drill bit is rotated. Ideally, the circular paths of the collection of shear cutters slightly overlap such that a continuous band of shear cutting is achieved over a majority of the area in the bore hole bottom surface.

Figure 4:
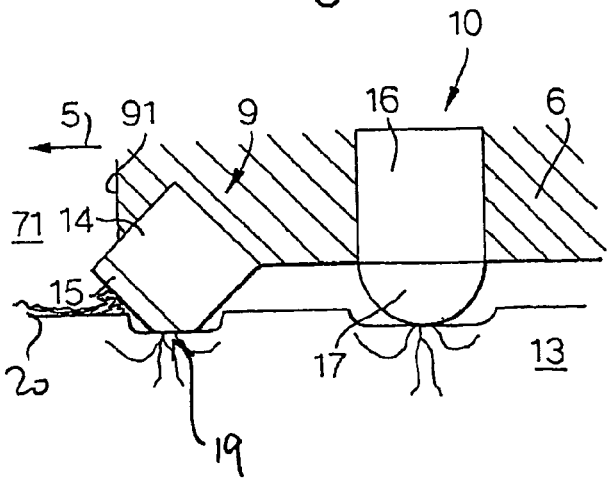
FIG. 4 shows a schematic cross section of the cutter arrangement.

FIG. 4 depicts a schematic representation of the cutter arrangement, as seen in a tangential cross section. Visible are a blade 6 and its leading edge 91. A shear cutter 9 is provided on or adjacent to the leading edge 91, to shear-cut the earth formation 13 and scrape off cutting debris 20 into the flow channel 71. Behind the shear cutter 9 in relation to the direction of rotary movement 5, is an axial cutter 10.

The shear cutter 9 has a shear cutter shank 14 made of a hard material, for which tungsten carbide is suitable. The rake surface facing the associated flow channel 71, is covered with a layer 15 of polycrystalline diamond. Such a shear cutter having a polycrystalline diamond cutting surface is known as a polycrystalline diamond compact cutter, or PDC cutter. In addition to the rake surface, the shear cutter is provided with a pre-cut flat impact surface 19 stretching essentially perpendicular to the central longitudinal axis of the drill bit and essentially parallel to the bottom hole surface of the earth formation 13.

The axial cutter 10 is formed of an axial cutter shank 16 which at least on one side is provided with a hemispherical or dome shaped cutting surface 17. The cutter is made of a hard material, for which tungsten carbide is a suitable material. Optionally, the cutter can be provided with a layer of polycrystalline diamond thus forming a PDC axial cutter.

In order to protect the shear cutter 9 from full exposure to the percussive impacts, they may be arranged recessed with respect to the axial cutters 10,11 such that the axial cutters 10,11 impact on the rock 13 in the bottom of the bore hole before the shear cutter 9 does. Ideally, the recessed arrangement causes the shear cutter 9 to be elevated above the rock 13 in the bottom of the bore hole, at a height corresponding to the amount of recess, when the axial cutters 10,11 just start to penetrate a fresh piece of rock 13. When the impact follows through, the final penetration depth of the shear cutter 9 is less than that of the axial cutters 10,11 by an amount corresponding to the amount of recess. Any amount of recess has a beneficial effect on the operational lifetime of the shear cutters, but a recessed arrangement by at least 0.25 mm is recommended, while at least 0.50 mm is preferred.

In the examples shown in FIGS. 1*a* and 1*b*, FIGS. 2*a* and 2*b*, and FIG. 3, the outermost axial cutters 11 are PDC axial cutters and the other axial cutters 10 are tungsten carbide axial cutters. Thus, in these bit faces the outer most axial cutters 11 are harder and/or more wear resistant than the remaining axial cutters 10.

Figure 5:
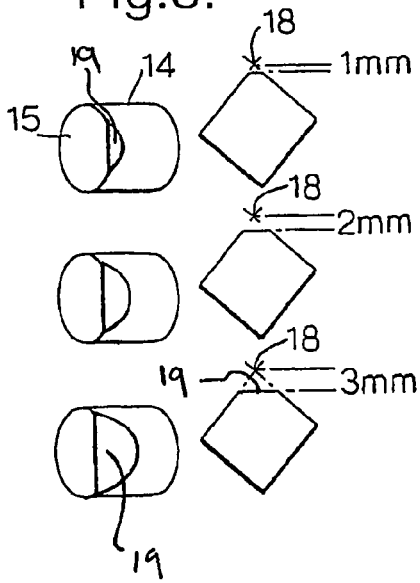
FIG. 5 schematically shows different shear cutters having pre-cut flat impact surfaces.

The shear cutters 9 are PDC cutters. FIG. 5 schematically shows the provision of the pre-cut flat impact surface 19 on these shear cutters for different pre-cutting depths of 1 mm, 2 mm and 3 mm. The pre-cutting depth corresponds to the normal distance between the pre-cut impact surface 19 and the summit point 18 where the shear cutter shank outer shell and the rake surface come together. The back-rake angle of each of these shear cutters is 40° as an example, but any angle smaller than 90° can be applied.

It can be seen that the pre-cut flat impact surface area increases as the pre-cutting depth increases. Preferably, the pre-cutting depth is between 1 and 3 mm.

In operation, the percussion drill bit is incorporated in a drilling system whereby the percussion drill bit is held by a drill string. The drilling system further comprises:

first drive means for rotating the drill bit in the borehole so as to induce a scraping movement of the shear cutters along the borehole bottom; and second drive means for inducing a longitudinal reciprocal movement of the drill bit in the borehole so as to induce at least the axial cutters to exert a percussive force to the borehole bottom, which first and second drive means are both operated simultaneously. The second drive means are preferably formed by a hammer, more preferably a reciprocative piston hammer. During a drilling operation, a drilling fluid is pumped through the drill string which is in fluid connection with the passages 8, 81, 82, 83. Suitable drilling fluids are mud, water, oil or foam, and can vary in dependence of the type of formation to be drilled.

As can best be seen in FIG. 4, the axial cutters 10,11 and the shear cutters 9 both are in contact with the earth formation 13, so that the percussive impact force is distributed over as many cutters as possible. Herewith the operational lifetime of the cutters is sustained as much as possible. In order to reduce the impact stress concentration acting on the shear cutters, the shear cutters are provided with a pre-cut impact surface as described above. These pre-cut impact surfaces, which can also be viewed upon as pre-cut wear flats, are also beneficial in reducing the tendency to excite so-called slip-stick torsional vibrations in the drilling system.

As a result of the axial percussive impacts, the formation 13 underneath the cutters crushes. As the bit rotates, the shear cutters 9 scrape along the bottom hole surface and build up rock flour and chips from the cutting debris and drilling fluid. The rock flour and chips are pushed in front of the shear cutters 9 where there is a flow channel 7 with flushing fluid running through it in an essentially radially outward direction. Herefrom the scraped cutting debris is flushed to the bore hole annulus and removed from the bottom hole area.

In order to further assist the flushing of cutting debris though the flow channels, the rake surface of each shear cutter can have a secondary inclination relative to the radial direction of the drill bit, the secondary inclination being such that the rake surface pushes drill cuttings from the rock formation in radially outward or radially inward direction.

Typical suitable operating conditions for the drill bits described above, include a weight on bit lying in a range between 3 to 6 metric tons. The amount of percussive energy exercised on the drill bit per percussive blow can lie in a range of between 0.3 kJ to 5 kJ. Typically, the drilling system can be operated using between 10 and 50 kW of percussive power, at a percussion frequency between 9 and 30 Hz.

The percussion drill bits shown and described above have 6" and 8" outer diameters by way of example. It will be understood that other diameters can be applied in a similar fashion. Likewise, the invention is not limited by the number of blades shown. Any number of blades can be provided.

I claim:

1. A percussion drill bit for drilling into a subterranean earth formation, the drill bit having a central longitudinal axis and being operable by applying axial percussive motion along the axis and rotary motion about the axis, the drill bit comprising:

a plurality of blades protruding from the drill bit;

a plurality of flow channels stretching along the drill bit in a substantially radial direction whereby the successive flow channels are formed between two adjacent blades;

shear cutters which are provided in a row on or close to the leading edge of at least one of said blades with respect to the direction of rotary motion trailingly adjacent to the flow channel that is associated with it, for running a fluid through and thereby removing cutting debris accumulating in front of the row of shear cutters; and in addition to these shear cutters, axial impact cutters which are located, with respect to the direction of rotary motion, in a trailing position with respect to said row of shear cutters and its associated flow channel.

2. The percussion drill bit of claim 1, wherein the axial cutters are provided ahead of the subsequent neighbouring flow channel with respect to the direction of rotary motion.

3. The percussion drill bit of claim 2, wherein the subsequent neighbouring flow channel is associated with a second row of shear cutters provided on the leading edge of the subsequent blade to the said at least one blade.

4. The percussion drill bit of claim 1, wherein the axial cutters are located on the same blade as the shear cutters.

5. The percussion drill bit of claim 1, wherein the axial cutters are arranged such that the penetration depth of said shear cutters is less than that of the axial cutters.

6. The percussion drill bit of claim 1, wherein the axial cutters are formed essentially of tungsten carbide.

7. The percussion drill bit of claim 6, wherein the axial cutters are provided with an outer layer of polycrystalline carbon.

8. The percussion drill bit of claim 1, wherein there are more axial cutters provided than shearing cutters.

9. The percussion drill bit of claim 1, wherein the ratio between the number of axial cutters and the number of shearing cutters provided is at least 3:2.

10. The percussion drill bit of claim 1, wherein the shear cutters in a first said row of shear cutters are positioned at mutually different radial positions than the shear cutters in a second said row of shear cutters on another blade.

11. The percussion drill bit of claim 1, wherein the shear cutters have a rake surface facing the flow channel associated with it at a back-rake angle of less than 90° wherein the back-rake angle is defined as the included angle between the projection of a line perpendicular to said rake surface on a plane defined by said central longitudinal axis of the drill bit and the tangential direction of rotary motion, and a plane perpendicular to said longitudinal axis.

12. The percussion drill bit of claim 1, wherein one or more of the shear cutters is provided with a pre-cut flat impact surface essentially parallel to the plane perpendicular to the central longitudinal axis.

13. A drilling system for drilling a borehole in an earth formation, comprising a drill string provided with a percussion drill bit having a central longitudinal axis and being operable by applying axial percussive motion along the axis and rotary motion about the axis, the drill bit comprising:

a plurality of blades protruding from the drill bit;

a plurality of flow channels stretching along the drill bit in a substantially radial direction whereby the successive flow channels are formed between two adjacent blades;

shear cutters which are provided in a row on or close to the leading edge of at least one of said blades with respect to the direction of rotary motion trailingly adjacent to the flow channel that is associated with it, for running a fluid through and thereby removing cutting debris accumulating in front of the row of shear cutters; and in addition to these shear cutters; and axial impact cutters which are located, with respect to the direction of rotary motion, in a trailing position with respect to said row of shear cutters and its associated flow channel, the drilling system further comprising:

first drive means for rotating the drill bit in the borehole so as to induce a scraping movement of the shear cutters along the borehole bottom; and second drive means for inducing a longitudinal reciprocal movement of the drill bit in the borehole so as to induce at least the axial cutters to exert a percussive force to the borehole bottom.

14. A method of drilling a bore hole into a subterranean earth formation, comprising the steps of providing a drilling system comprising a drill string provided with a percussion drill bit having a central longitudinal axis and being operable by applying axial percussive motion along the axis and rotary motion about the axis, the drill bit comprising:

a plurality of blades protruding from the drill bit;

a plurality of flow channels stretching along the drill bit in a substantially radial direction whereby the successive flow channels are formed between two adjacent blades;

shear cutters which are provided in a row on or close to the leading edge of at least one of said blades with respect to the direction of rotary motion trailingly adjacent to the flow channel that is associated with it, for running a fluid through and thereby removing cutting debris accumulating in front of the row of shear cutters; and in addition to these shear cutters; and axial impact cutters which are located, with respect to the direction of rotary motion, in a trailing position with respect to said row of shear cutters and its associated flow channel, first drive means for rotating the drill bit in the borehole so as to induce a scraping movement of the shear cutters along the borehole bottom, and second drive means for inducing a longitudinal reciprocal movement of the drill bit in the borehole so as to induce at least the axial cutters to exert a percussive force to the borehole bottom; and placing the drill bit against the subterranean earth formation that is to be drilled, exercising a rotary motion about the axis while maintaining a force on the drill bit against the earth formation in the axial direction, and intermittingly providing percussive strikes on the drill bit.

15. The percussion drill bit of claim 13, wherein the axial cutters are provided ahead of the subsequent neighbouring flow channel with respect to the direction of rotary motion.

16. The percussion drill bit of claim 13, wherein the axial cutters are formed essentially of tungsten carbide.

17. The percussion drill bit of claim 16, wherein the axial cutters are provided with an outer layer of polycrystalline carbon.

18. The percussion drill bit of claim 13, wherein the ratio between the number of axial cutters and the number of shearing cutters provided is at least 3:2.

19. The percussion drill bit of claim 13, wherein the shear cutters have a rake surface facing the flow channel associated with it at a back-rake angle of less than 90° wherein the back-rake angle is defined as the included angle between the projection of a line perpendicular to said rake surface on a plane defined by said central longitudinal axis of the drill bit and the tangential direction of rotary motion, and a plane perpendicular to said longitudinal axis.

20. The percussion drill bit of claim 13, wherein one or more of the shear cutters is provided with a pre-cut flat impact surface essentially parallel to the plane perpendicular to the central longitudinal axis.

* * * * *